US010343863B2

(12) United States Patent
Moriuchi

(10) Patent No.: US 10,343,863 B2
(45) Date of Patent: Jul. 9, 2019

(54) SHEET FEEDING DEVICE

(71) Applicant: KYOCERA Document Solutions Inc., Osaka-shi, Osaka (JP)

(72) Inventor: Mariko Moriuchi, Osaka (JP)

(73) Assignee: KYOCERA Document Solutions Inc., Osaka-Shi, Osaka (JP)

( * ) Notice: Subject to any disclaimer, the term of this patent is extended or adjusted under 35 U.S.C. 154(b) by 13 days.

(21) Appl. No.: 15/842,915

(22) Filed: Dec. 15, 2017

(65) Prior Publication Data

US 2018/0170698 A1 Jun. 21, 2018

(30) Foreign Application Priority Data

Dec. 16, 2016 (JP) ..... 2016-244667

(51) Int. Cl.
*B65H 29/58* (2006.01)
*B65H 29/60* (2006.01)
(Continued)

(52) U.S. Cl.
CPC ..... *B65H 5/36* (2013.01); *B65H 1/04* (2013.01); *B65H 1/266* (2013.01); *B65H 3/06* (2013.01);
(Continued)

(58) Field of Classification Search
CPC ... B65H 7/02; B65H 7/04; B65H 7/06; B65H 7/14; B65H 2511/511; B65H 2511/515;
(Continued)

(56) References Cited

U.S. PATENT DOCUMENTS 5,651,538 A * 7/1997 Chung ..... B41J 13/10 271/9.02
5,826,135 A * 10/1998 Lee ..... B65H 7/00 399/43
(Continued)

FOREIGN PATENT DOCUMENTS

JP 06135074 A * 5/1994
JP 2005263432 A * 9/2005
(Continued)

*Primary Examiner* — Luis A Gonzalez
(74) *Attorney, Agent, or Firm* — Viering, Jentschura & Partner MBB

(57) ABSTRACT

This sheet feeding device includes a paper transport path, a first paper pass detection unit, a second paper pass detection unit, a transport processing mechanism, an actuation determining section, and a detection control section. The first paper pass detection unit detects that the paper passes through a first point on the paper transport path. The second paper pass detection unit detects that the paper passes through a second point on the paper transport path. The transport processing mechanism performs predetermined transportation processing on the paper traveling on the paper transport path. The actuation determining section determines whether the transport processing mechanism has been actuated. The detection control section controls the first paper pass detection unit to constantly perform detection, and, if the actuation determining section detects that transport processing mechanism has been actuated, controls the second paper pass detection unit to perform detection except for a certain time period.

11 Claims, 8 Drawing Sheets

(51) Int. Cl.

| | |
|---|---|
| ***B65H 7/02*** | (2006.01) |
| ***B65H 5/36*** | (2006.01) |
| ***B65H 1/04*** | (2006.01) |
| ***B65H 1/26*** | (2006.01) |
| ***B65H 3/06*** | (2006.01) |
| ***B65H 43/08*** | (2006.01) |
| ***B65H 5/06*** | (2006.01) |
| ***B65H 43/00*** | (2006.01) |
| ***B65H 85/00*** | (2006.01) |
| ***B65H 7/06*** | (2006.01) |

(52) U.S. Cl.
CPC ..... *B65H 5/062* (2013.01); *B65H 7/02* (2013.01); *B65H 7/06* (2013.01); *B65H 29/58* (2013.01); *B65H 29/60* (2013.01); *B65H 43/00* (2013.01); *B65H 43/08* (2013.01); *B65H 85/00* (2013.01); *B65H 2301/33312* (2013.01); *B65H 2301/341* (2013.01); *B65H 2301/4482* (2013.01); *B65H 2511/52* (2013.01); *B65H 2513/511* (2013.01); *B65H 2513/53* (2013.01); *B65H 2701/1311* (2013.01); *B65H 2701/1313* (2013.01); *B65H 2801/06* (2013.01)

(58) Field of Classification Search
CPC ..... B65H 2511/528; B65H 2513/50; B65H 2513/512; B65H 2513/514; B65H 2513/53; B65H 29/58; B65H 29/60; B65H 29/62; B65H 2301/3331; B65H 2301/333312; B65H 2301/333
See application file for complete search history.

(56) References Cited

U.S. PATENT DOCUMENTS

| | | | | |
|---|---|---|---|---|
| 7,591,467 | B2 * | 9/2009 | Terada | B65H 7/02 271/273 |
| 8,439,357 | B2 * | 5/2013 | Arikawa | G03G 15/234 271/184 |
| 8,757,618 | B2 * | 6/2014 | Matsumoto | B65H 7/02 271/264 |
| 2013/0120778 | A1 | 5/2013 | Tanonaka | |
| 2014/0319763 | A1 * | 10/2014 | Maruta | B65H 7/20 271/228 |

FOREIGN PATENT DOCUMENTS

| | | | |
|---|---|---|---|
| JP | 2013-126916 | A | 6/2013 |
| JP | 2016039377 | A * | 3/2016 |

* cited by examiner

SHEET FEEDING DEVICE

CROSS REFERENCE TO RELATED APPLICATIONS

This application claims priority to Japanese Patent Application No. 2016-244667, which was filed on Dec. 16, 2016, and is incorporated herein by reference in its entirety.

BACKGROUND

The present disclosure relates to a sheet feeding device and an image forming apparatus.

An image forming apparatus, typified by a multifunction peripheral, emits light to a photoreceptor based on image data to form an electrostatic latent image on the photoreceptor. Then, the image forming apparatus applies charged toner onto the formed electrostatic latent image to make it into a visible image that is in turn transferred onto a sheet of paper and fixed, and then discharged outside the apparatus.

There are some well-known techniques of transporting paper.

A conventional sheet feeding device is adapted to feed paper to a main body of an image forming apparatus for printing and outputting paper. The sheet feeding device includes a conveyance path that conveys paper towards the main body, a paper detection section that has a paper sensor for detecting paper on the conveyance path, and that, on the basis of an output value of the paper sensor, generates a paper detection signal representing the state of conveyance of the paper, and an output section that outputs the paper detection signal to the main body that recognizes the state of conveyance of the paper on the basis of the paper detection signal. During a paper leading edge detection period including an expected point in time at which the leading edge of the paper arrives at a paper sensor installation location, and during a paper trailing edge detection period including an expected point in time at which the trailing edge of the paper passes through the paper sensor installation location, the paper detection section allows the signal level of the paper detection signal that is output from the output section to the main body to fluctuate on the basis of an actual output value of the paper sensor. On the other hand, during a transition period from the paper leading edge detection period to the paper trailing edge detection period, the paper detection section locks the paper detection signal that is output from the output section to the main body section, to the signal level at the end of the paper leading edge detection period, regardless of the output value of the paper sensor.

SUMMARY

In one aspect of the present disclosure, a sheet feeding device feeds paper. This sheet feeding device includes a paper transport path, a first paper pass detection unit, a second paper pass detection unit, a transport processing mechanism, an actuation determining section, and a detection control section. The paper transport path serves as a route through which the paper is conveyed. The first paper pass detection unit detects that the paper passes through a first point on the paper transport path. The second paper pass detection unit detects that the paper passes through a second point, which is different from the first point, on the paper transport path. The transport processing mechanism performs predetermined transportation processing on the paper traveling on the paper transport path. The actuation determining section determines whether the transport processing mechanism has been actuated. The detection control section controls the first paper pass detection unit to constantly perform detection, and, if the actuation determining section detects that transport processing mechanism has been actuated, controls the second paper pass detection unit to perform detection except for a certain time period.

In another aspect of the present disclosure, an image forming apparatus includes a sheet feeding device for feeding paper, and an image forming unit for forming images on the paper fed by the sheet feeding device. The sheet feeding device includes a paper transport path, a first paper pass detection unit, a second paper pass detection unit, a transport processing mechanism, an actuation determining section, and a detection control section. The paper transport path serves as a route through which the paper is conveyed. The first paper pass detection unit detects that the paper passes through a first point on the paper transport path. The second paper pass detection unit detects that the paper passes through a second point, which is different from the first point, on the paper transport path. The transport processing mechanism performs predetermined transportation processing on the paper traveling on the paper transport path. The actuation determining section determines whether the transport processing mechanism has been actuated. The detection control section controls the first paper pass detection unit to constantly perform detection, and, if the actuation determining section detects that transport processing mechanism has been actuated, controls the second paper pass detection unit to perform detection except for a certain time period.

DETAILED DESCRIPTION

Figure 1:
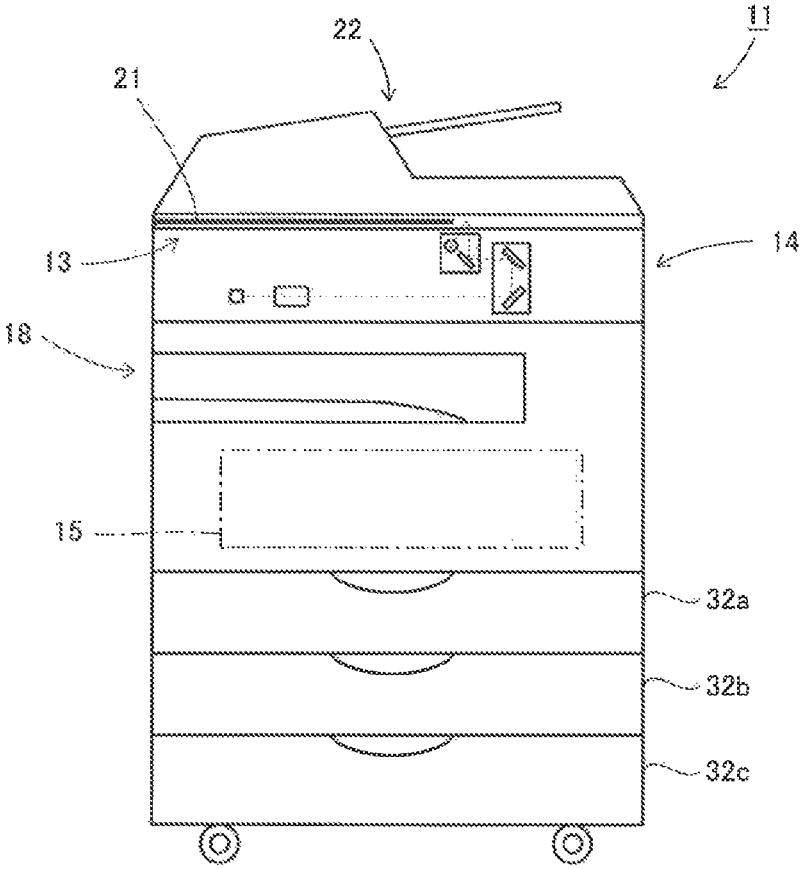
FIG. 1 is a schematic external view of a multifunction peripheral to which an image forming apparatus including a sheet feeding device according to an embodiment of the present disclosure is applied.
Figure 2:
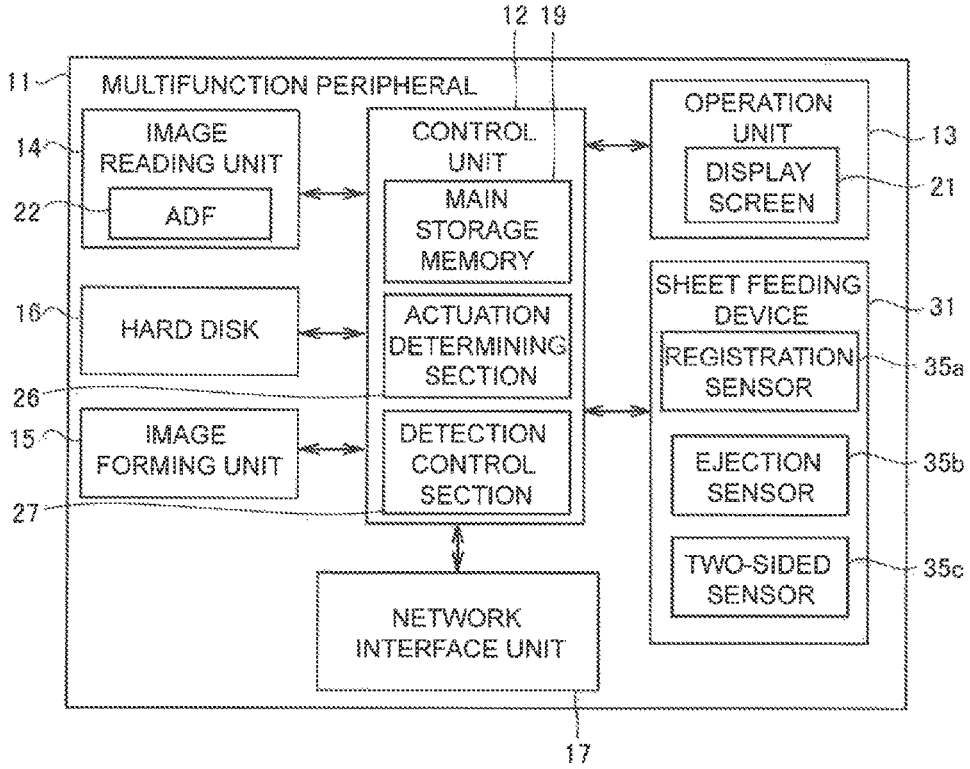
FIG. 2 is a block diagram showing the configuration of the multifunction peripheral shown in FIG. 1.

Reference is made below to an embodiment of the present disclosure. FIG. 1 depicts a multifunction peripheral 11 to which an image forming apparatus including a sheet feeding device according to the embodiment of the present disclosure is applied. FIG. 2 is a block diagram showing the configuration of the multifunction peripheral shown in FIG. 1.

Referring to FIGS. 1 and 2, the multifunction peripheral 11 has a plurality of functions relating to image processing, such as a copying function, a printer function, and a facsimile function. The multifunction peripheral 11 includes a control unit 12, an operation unit 13, an image reading unit 14, an image forming unit 15, a hard disk 16, a network interface unit 17 connecting the multifunction peripheral 11 to a network (not shown), an ejection tray 18, and a sheet feeding device 31 feeding sheets of paper. The image forming unit 15 in FIG. 1 and other drawings is indicated schematically with a dot-and-dash line for the sake of clarity.

The control unit 12 controls the entire multifunction peripheral 11. The control unit 12 is composed of a central processing unit (CPU) and some other components, and includes a main storage memory 19 that temporarily stores data. The operation unit 13 includes a touch panel type display screen 21 that serves as a display unit displaying information submitted from the multifunction peripheral 11 and information entered by users. The image reading unit 14 includes an auto document feeder (ADF) 22 serving as a document transporting device that transports an original document placed on a loading position to a reading position. The image reading unit 14 reads images of an original document loaded in the ADF 22 or placed on a document table (not shown). The image forming unit 15 forms images on paper based on images read by the image reading unit 14 or image data transmitted via the network (not shown). Specifically, the image forming unit 15 forms an image on a sheet of paper fed by the sheet feeding device 31. The image forming unit 15 has so-called two-sided printing (also referred to as double-sided printing or duplex printing) capability. The sheet of paper with the image formed thereon is ejected onto the ejection tray 18. The hard disk 16 stores image data, and other types of data, such as input image forming conditions. The hard disk 16 also stores data about types of paper to be used for image formation and data about the thickness of the corresponding types of paper.

Figure 3:
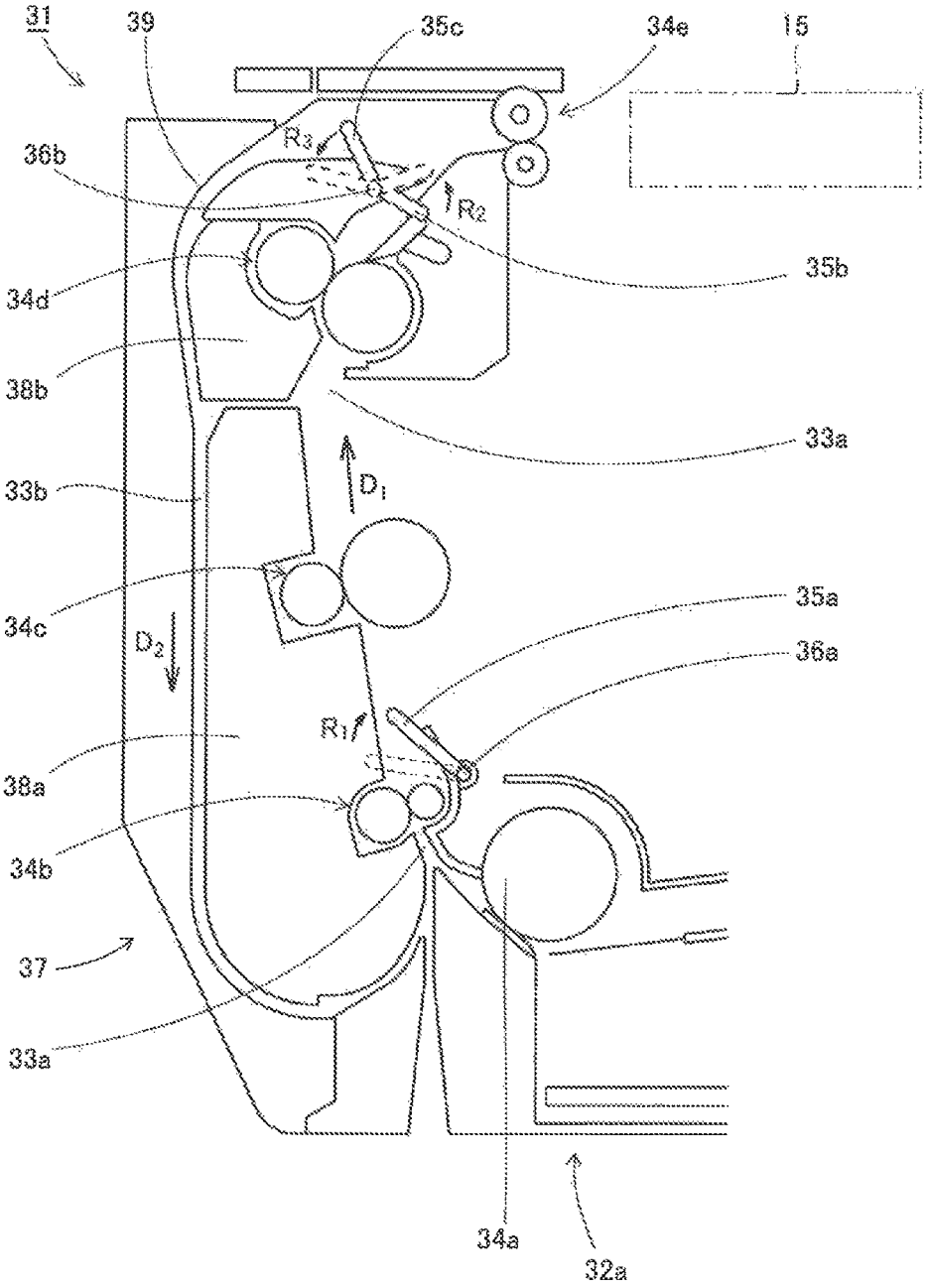
FIG. 3 shows the configuration of a part of the sheet feeding device without paper.
Figure 4:
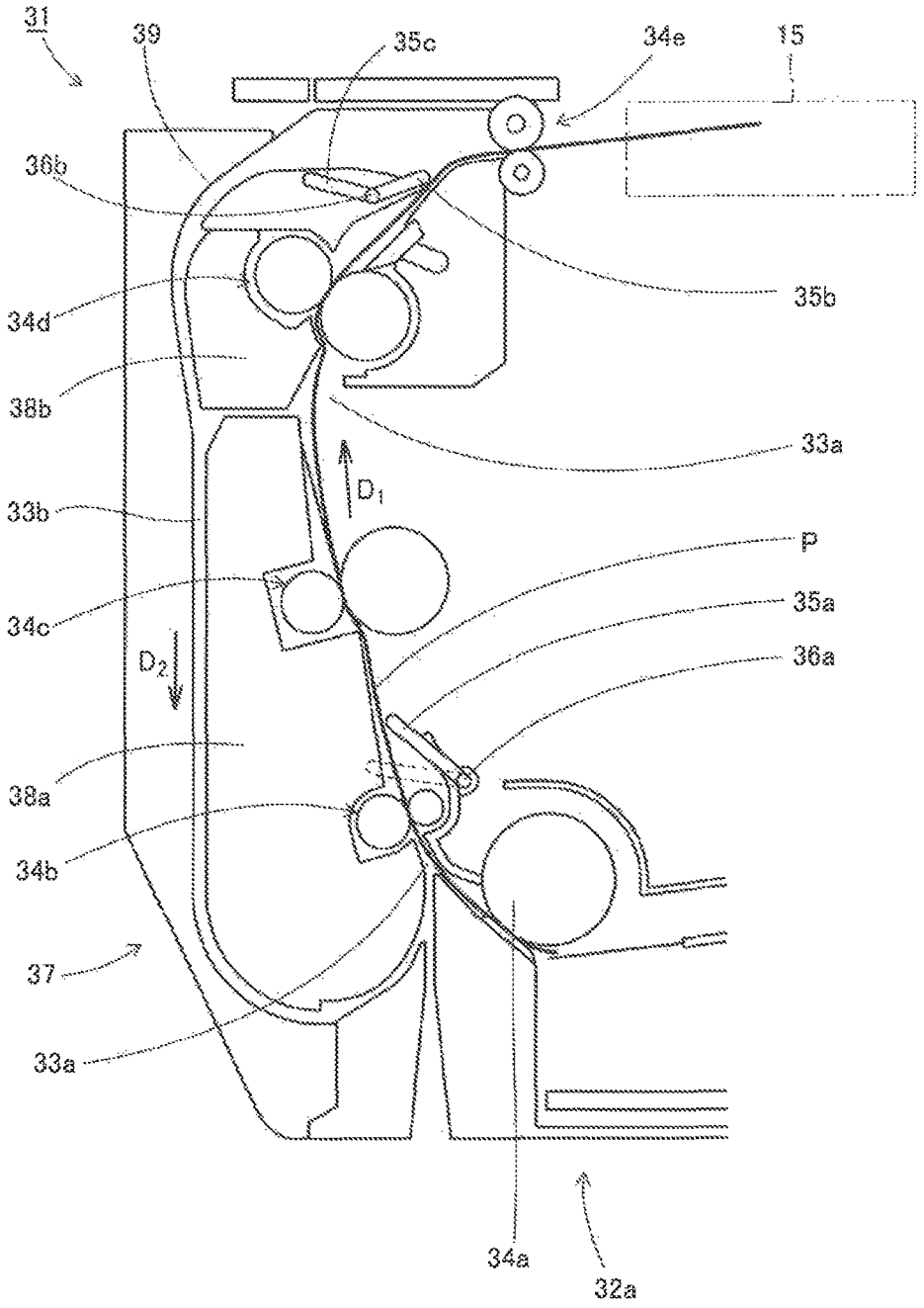
FIG. 4 shows the configuration of the part of the sheet feeding device with paper conveyed on a paper transport path.
Figure 5:
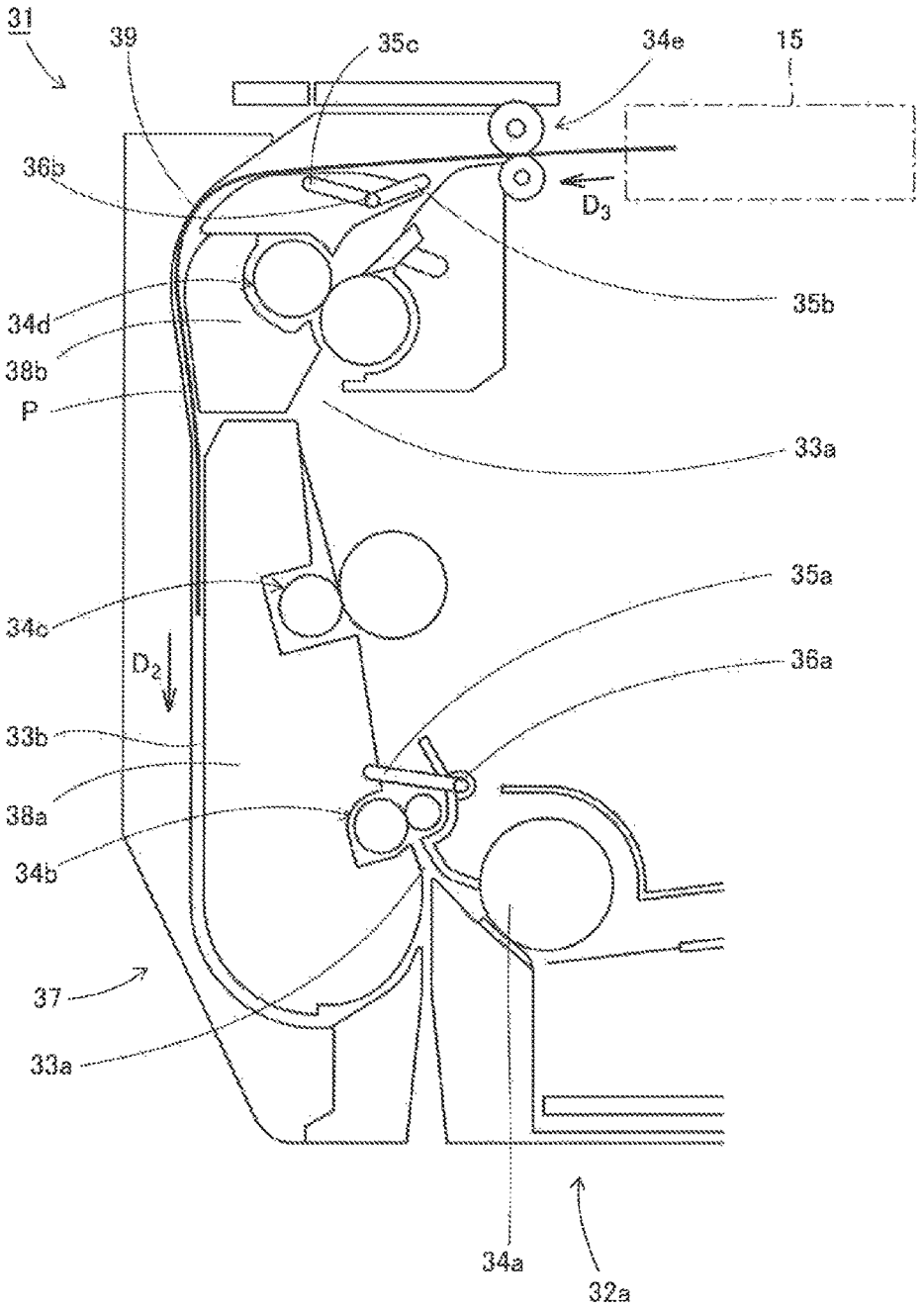
FIG. 5 shows the configuration of the part of the sheet feeding device with paper conveyed on a paper transport path.

Next, the configuration of the sheet feeding device 31 will be described. FIGS. 3, 4 and 5 respectively show the configuration of a part of the sheet feeding device 31. FIG. 3 does not show paper P to be fed; however, FIG. 4 shows paper P traveling on a paper transport path 33*a*, and FIG. 5 shows paper P traveling on a paper transport path 33*b*, both paper transport paths being described later.

With reference to FIGS. 3 to 5 all together, the sheet feeding device 31 feeds paper toward the main body of the multifunction peripheral 11, more specifically, to the image forming unit 15. The sheet feeding device 31 includes three paper feed cassettes 32*a*, 32*b*, 32*c* each holding sheets of paper, two paper transport paths 33*a*, 33*b* serving as a route through which the paper is conveyed, a feeding roller 34*a*, pairs of transport rollers 34*b*, 34*c*, 34*d* that are placed along the paper transport path 33*a*, a pair of ejection rollers 34*e*, a registration sensor 35*a* as a detecting member, an ejection sensor 35*b*, a two-sided sensor 35*c*, a switchback mechanism 37 that serves as a transport processing mechanism performing backward feed processing on paper P. The switchback mechanism 37 performs predetermined transport processing on paper traveling on the paper transport paths 33*a*, 33*b*. The predetermined transport processing herein is specifically to feed the paper backward for two-sided printing.

Each of the three paper feed cassettes 32*a*, 32*b*, 32*c* holds a stack of paper sheets therein. In addition, each of the paper feed cassettes 32*a* to 32*c* can hold paper sheets of different sizes and types. The paper feed cassettes 32*a* to 32*c* are detachably provided adjacent to the main body of the multifunction peripheral 11. Specifically, the paper feed cassette 32*a* is placed at the top, the paper feed cassette 32*b* is placed thereunder, and the paper feed cassette 32*c* is placed at the bottom. The feeding roller 34*a* is provided to respective paper feed cassettes 32*a* to 32*c* to pick up a sheet of paper that is placed at the top of the paper sheet stack.

The paper transport path 33*a* is a route through which the paper P is conveyed from the paper feed cassette 32*a* to the image forming unit 15. Therefore, the paper transport path 33*a* is designed to extend from the paper feed cassette 32*a*. The paper P is moved in the direction indicated by an arrow D1 in the paper transport path 33*a*. The paper transport path 33*b* is used to perform two-sided printing by means of the switchback mechanism 37. Specifically, paper P whose front side is printed by the image forming unit 15 passes through the paper transport path 33*b* to return to the paper transport path 33*a*. Since the paper P is conveyed backward by means of the switchback mechanism 37, the paper P travels with its front side and back side turned over. The paper P is fed again to the image forming unit 15 that prints the back side of the paper P, and is in turn ejected to the ejection tray 18. The paper transport paths 33*a* and 33*b* are physically separated from each other by housing parts 38*a*, 38*b* interposed therebetween.

The feeding roller 34*a* is designed to contact the top face of paper P stacked in the paper feed cassette 32*a* set in the multifunction peripheral 11. The paper P held in the paper feed cassette 32*a* is picked up one by one by the rotating feeding roller 34*a* into the paper transport path 33*a*, and fed to the main body of the multifunction peripheral 11. The transport rollers 34*b*, 34*c*, 34*d* are placed apart from each other at predetermined positions along the paper transport path 33*a*. The transport rollers 34*b* to 34*d* are placed in this order from the upstream side of the paper transport path 33*a*. FIGS. 3 to 5 show the transport rollers 34*b* to 34*d* in this order from the lower side of the drawings. The paper P fed into the paper transport path 33*a* is conveyed to the downstream side, which is the upper side in FIGS. 3 to 5, of the paper transport path 33*a* by the feeding roller 34*a* and the transport rollers 34*b*, 34*c*, 34*d*. The ejection rollers 34*e* are placed at the most downstream side of the paper transport path 33*a*. Then, the paper P is ejected from the paper transport path 33*a* by the ejection rollers 34*e*, and is sent to the image forming unit 15. The image forming unit 15 forms an image on the front side of the paper P. In the case of one-sided printing, the paper P that has received the image on its front side is transported, without being transported to the paper transport path 33*b*, to the ejection tray 18 by transport rollers (not shown) provided to the image forming unit 15 or other units, and ejected outside the multifunction peripheral 11.

The registration sensor 35*a* is placed at some point on the paper transport path 33*a*, but downstream from the transport rollers 34*b*. More specifically, the registration sensor 35*a* is placed between the pair of transport rollers 34*b* and the pair of transport rollers 34*c* on the paper transport path 33*a*. The registration sensor 35*a* is designed to turn on a pivot 36*a*, serving as a fulcrum, within a predetermined angle range in the direction indicated by an arrow R1 in FIG. 3. Specifically, the registration sensor 35*a* is designed to be set at a position indicated by a solid line or a position indicated by a dashed line in FIG. 3. When paper P is not present at a position where the registration sensor 35*a* is provided, the registration sensor 35*a* is set at the position indicated by the dashed line under its own weight and for some other reasons. At this moment, the detection status of the registration sensor 35*a* is OFF. When paper P is passing through the position where the registration sensor 35*a* is provided, the paper P pushes up the registration sensor 35*a* to the position indicated by the solid line in FIG. 3. At this moment, the detection status of the registration sensor 35*a* is ON. After the paper P has passed through the position where the registration sensor 35*a* is provided, the registration sensor 35*a* is moved back to the position indicated by the dashed line. Then, the detection status of the registration sensor 35*a* returns to OFF. Thus, the registration sensor 35*a* detects that the paper P, which is supposed to be conveyed from the paper feed cassette 32*a* to the image forming unit 15 through the paper transport path 33*a*, passes through the position where the registration sensor 35*a* is provided. More specifically, the registration sensor 35*a* detects its own status, the ON state or OFF state, which is associated with the movement of the registration sensor 35*a*, thereby to detect the time when the leading edge of the paper P has reached the position where the registration sensor 35*a* is provided and the time when the trailing edge of the paper P has passed through the position.

The ejection sensor 35*b* is placed at some point on the paper transport path 33*a*, but downstream from the transport rollers 34*d*. More specifically, the ejection sensor 35*b* is placed between the pair of transport rollers 34*d* and the pair of ejection rollers 34*e* on the paper transport path 33*a*. The ejection sensor 35*b* is designed to turn on a pivot 36*b*, serving as a fulcrum, within a predetermined angle range in the direction indicated by an arrow R2 in FIG. 3. Note that the two-sided sensor 35*c*, which will be described later, is provided so as to be operatively associated with and moved together with the ejection sensor 35*b* on the pivot 36*b* interposed therebetween. The ejection sensor 35*b* and two-sided sensor 35*c* make up a boomerang-shaped member as viewed in profile in FIGS. 3 to 5. When paper P is not present at a position where the ejection sensor 35*b* is provided, the ejection sensor 35*b* is set at a position indicated by a solid line. At this moment, the detection status of the ejection sensor 35*b* is OFF. When paper P is passing through the position where the ejection sensor 35*b* is provided, the paper P pushes up the ejection sensor 35*b* to a position indicated by a broken line in FIG. 3. At this moment, the detection status of the ejection sensor 35*b* is ON. After the paper P has passed through the position where the ejection sensor 35*b* is provided, the ejection sensor 35*b* is moved back to the position indicated by the solid line. Then, the detection status of the registration sensor 35*a* returns to OFF. The ejection sensor 35*b* detects that the paper P, which is supposed to be conveyed from the paper feed cassette 32*a* to the image forming unit 15 through the paper transport path 33*a*, passes through the position where the ejection sensor 35*b* is provided. More specifically, the ejection sensor 35*b* detects its own status, the ON state or OFF state, which is associated with the movement of the ejection sensor 35*b*, thereby to detect the time when the leading edge of the paper P has reached the position where the ejection sensor 35*b* is provided and the time when the trailing edge of the paper P has passed through the position.

The switchback mechanism 37 provided in the sheet feeding device 31 enables the multifunction peripheral 11 to print both sides of paper P. Specifically, once the paper P receives an image on the front side, the paper P is transported backward in the direction indicated by an arrow D3 in FIG. 5, and is fed into the paper transport path 33*b*. For backward feed, the ejection rollers 34*e* are rotated in the reverse direction to the direction in which the paper P is transported as indicated by the arrow D1. Then, the paper P is conveyed to the paper transport path 33*a* again and further to the image forming unit 15 to receive an image on the back side.

On the paper transport path 33*b* provided is the two-sided sensor 35*c*. Specifically, the two-sided sensor 35*c* is placed downstream from the ejection rollers 34*e* when the paper P is fed to the paper transport path 33*b* for two-sided printing. The two-sided sensor 35*c* is designed to turn on a pivot 36*b*, serving as a fulcrum, within a predetermined angle range in the direction indicated by an arrow R3 in FIG. 3. The two-sided sensor 35*c* is placed so as to be operatively associated with and moved together with the ejection sensor 35*b* as described above, and is rotatable within the same angle range as the ejection sensor 35*b*. When paper P is not present at a position where the two-side sensor 35*c* is provided, the two-sided sensor 35*c* is set at a position indicated by a solid line. At this moment, the detection status of the two-sided sensor 35*c* is OFF. When paper P is passing through the position where the two-sided sensor 35*c* is provided, the paper P pushes down the two-sided sensor 35*c* to a position indicated by a broken line in FIG. 3. At this moment, the detection status of the two-sided sensor 35*c* is ON. After the paper P has passed through the position where the two-sided sensor 35*c* is provided, the two-sided sensor 35*c* is moved back to the position indicated by the solid line. Then, the detection status of the registration sensor 35*a* returns to OFF. The two-sided sensor 35*c* detects that the paper P, which is supposed to be conveyed from the ejection rollers 34 side to the paper transport path 33*a* through the paper transport path 33*b*, passes through the position where the two-sided sensor 35*c* is provided. More specifically, the two-sided sensor 35*c* detects its own status, the ON state or OFF state, which is associated with the movement of the two-sided sensor 35*c*, thereby to detect the time when the leading edge of the paper P has reached the position where the two-sided sensor 35*c* is provided and the time when the trailing edge of the paper P has passed through the position.

A wall 39 that the leading edge of the paper P abuts against is positioned downstream from the ejection rollers 34*e* and is moderately curved in the direction to which the paper P is transported. In an area 43 around the wall 39, the paper transport path 33*b* has a relatively large space. The space is designed to be large enough for the transported paper P to slightly bend. The wall 39 and area 43 making up the paper transport path 33*b* smoothly guide the transported paper P into the paper transport path 33*b*.

The registration sensor 35*a* operates as a first paper pass detection unit. Specifically, the registration sensor 35*a* detects that the paper P passes through a first point on the paper transport path 33*a*. The two-sided sensor 35*c* operates as a second paper pass detection unit. Specifically, the two-sided sensor 35*c* detects that the paper P passes through a second point, which is different from the first point, on the paper transport path 33*b*. In addition, the first point is located before the position where the switchback mechanism 37 is provided on the paper transport path 33*a*, while the second point is located after the position where the switchback mechanism 37 is provided on the paper transport path 33*b*.

Next, the configuration of the control unit 12 will be described again. The control unit 12 includes an actuation determining section 26 and a detection control section 27. The actuation determining section 26 determines whether the switchback mechanism 37 has been actuated. The detection control section 27 enables the registration sensor 35*a* to perform detecting operation constantly. In addition, if the actuation determining section 26 determines that the switchback mechanism 37 has been activated, the detection control section 27 controls the two-sided sensor 35*c* to perform detection except for a certain time period. The configurations of these sections will be described later in detail.

Figure 6:
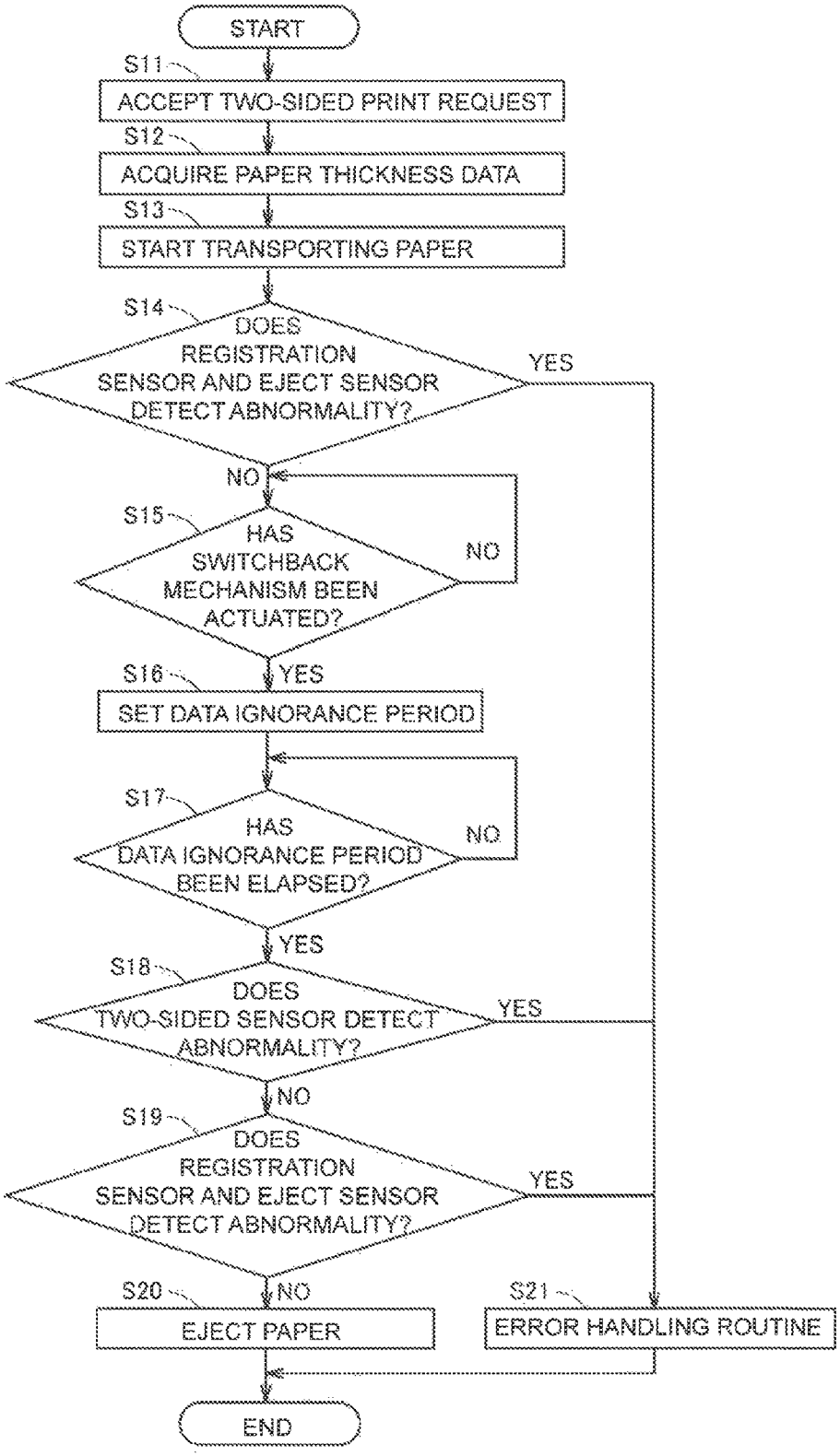
FIG. 6 is a flowchart illustrating process steps for forming images on both sides of the paper using the multifunction peripheral.

Next, a process of two-sided printing, more specifically, a process of forming images on both sides of paper P using the multifunction peripheral 11 including the aforementioned sheet feeding device 31 will be described. FIG. 6 is a flowchart illustrating process steps of forming images on both sides of the paper P using the multifunction peripheral 11.

Referring to FIG. 6, the multifunction peripheral 11 accepts a two-sided print request (step S11 in FIG. 6, hereinafter "step" is omitted). The two-sided print request is accepted through a display screen 21 of the operation unit 13. In acceptance of the two-sided print request, the multifunction peripheral 11 also accepts input of the type and size of the paper P, and further accepts the starting of the two-sided printing. Upon the acceptance of input of the type of the paper P, the multifunction peripheral 11 also acquires data about thickness associated with the type of the paper P (S12). The thickness data of the paper P is derived from the relationship between the type of the paper P and the thickness data of the paper P stored in the hard disk 16 as described above.

Then, transportation of the paper P begins (S13). Specifically, the feeding roller 34*a* picks up the top sheet of paper P in the paper feed cassette 32*a*, and feeds it into the paper transport path 33*a*.

Next, it is determined whether abnormal transportation of paper P has occurred on the paper transport path 33*a*. In this step, the registration sensor 35*a* determines whether it has detected abnormal transportation of the paper P (S14). If the registration sensor 35*a* detects abnormal transportation of the paper P (YES in S14), an error handling routine is performed and the process is terminated (S21). The abnormal transportation of the paper P to be detected by the registration sensor 35*a* includes a situation in which the registration sensor 35*a* does not detect a position of the leading edge of the paper P within a predetermined time period, and a situation in which the registration sensor 35*a* does not detect the trailing edge of the paper P passing through the sensor 35*a* after a lapse of the predetermined time period, after a press of a key (not shown) in the operation unit 13 for starting two-sided printing was detected. To this end, the timing at which the trailing edge of the paper P passes through a first point is calculated based on the size of the paper P input when the print request was made. Then, the timing is extended to a time period to allow for errors, and if the registration sensor 35*a* detects that the trailing edge of the paper P has not passed through the position of the registration sensor 35*a*, that is the first point, within the time period, it is determined that an abnormality has occurred. In this step, the detection control section 27 controls the registration sensor 35*a* to constantly perform detection, and therefore the registration sensor 35*a* can reliably detect abnormal transportation at the first point in the paper transport path 33*a*.

If the registration sensor 35*a* does not detect abnormal transportation of the paper P, the ejection sensor 35*b* determines whether it has detected abnormal transportation of the paper P (S14). If the ejection sensor 35*b* detects abnormal transportation of the paper P (YES in S14), an error handling routine is performed and the process is terminated as with the above case (S21).

Next, it is determined whether the switchback mechanism 37 has been actuated (S15). Since a two-side print request has been made in this example, it is determined that the switchback mechanism 37 has been actuated (S15). Specifically, for example, the switchback mechanism 37 includes a double-sided solenoid (not shown) to which current or other forms of power is supplied, and the actuation of the switchback mechanism 37 is determined depending on whether the double-sided solenoid is actuated with the power.

If it is determined that the switchback mechanism 37 has been actuated (YES in S15), a certain time period for the two-sided sensor 35*c* is calculated and set as a data ignorance period (S16). The data ignorance period is calculated based on, for example, data about the thickness of the paper P, and the calculated value is set. More specifically, if the paper P of the type input previously has a thickness thinner than that of standard paper, the data ignorance period calculated for the paper P is longer than that for the standard paper. In this case, the certain time period starts at the time at which the actuation determining section 26 determines that the switchback mechanism 37 has been actuated. The certain time period can be set longer as the thickness of paper P is thinner.

Then, it is determined whether the set data ignorance period has elapsed (S17). During the data ignorance period, the outputs from the two-sided sensor 35*c* are ignored. In this case, the two-sided sensor 35*c* is supposed to be in the ON state. In other words, even if the two-sided sensor 35*c* outputs that it is actually in the OFF state during the data ignorance period, the two-sided sensor 35*c* ignores the detection of the OFF state.

If it is determined that the data ignorance period has elapsed (YES in S17), it is subsequently determined whether the two-sided sensor 35*c* has detected an abnormality (S18). If the two-sided sensor 35*c* detects an abnormality (YES in S18), an error handling routine is performed and the process is terminated (S21). To this end, the timing at which the trailing edge of the paper P passes through the second point is calculated based on the size of the paper P input when the print request was made. Then, the timing is extended to a time period to allow for errors, and if the two-sided sensor 35*c* detects that the trailing edge of the paper P has not passed through the position of the two-sided sensor 35*c*, that is the second point, within the time period, it is determined that an abnormality has occurred. The detection control section 27 controls the two-sided sensor 35*c* to perform detection except for a certain time period. That is, the data ignorance period is provided. Thus, the multifunction peripheral 11 can detect abnormal transportation of the paper P in accordance with the actuation status of the switchback mechanism 37, while reducing the possibility of faulty detection.

If the two-sided sensor 35*c* does not detect abnormal transportation of the paper P, the paper P returns to the paper transport path 33*a*. While the paper P is being conveyed in the paper transport path 33*a*, the registration sensor 35*a* and ejection sensor 35*b* again determine whether the sensors have detected abnormal transportation of the paper P (S19). If at least one of the registration sensor 35*a* and ejection sensor 35*b* detects abnormal transportation of the paper P (YES in S19), an error handling routine is performed and the process is terminated (S21). On the other hand, if neither sensors detect abnormal transportation of the paper P (NO in S19), the paper P is conveyed to the ejection tray 18 to be ejected outside the multifunction peripheral 11 (S20), and the process is terminated. This means that two-sided printing for the paper P has been successfully completed.

Since the registration sensor 35*a* configured as described above is controlled so as to constantly perform detection, the registration sensor 35*a* can detect the traveling paper P more properly. In addition, since the two-sided sensor 35*c* is controlled so as to perform detection except for a certain time period when the switchback mechanism 37 is determined to be actuated, the two-sided sensor 35*c* can detect the traveling paper P in accordance with the actuation status of the switchback mechanism 37, while reducing the possibility of faulty detection. As a result, paper can be transported properly.

Figure 7:
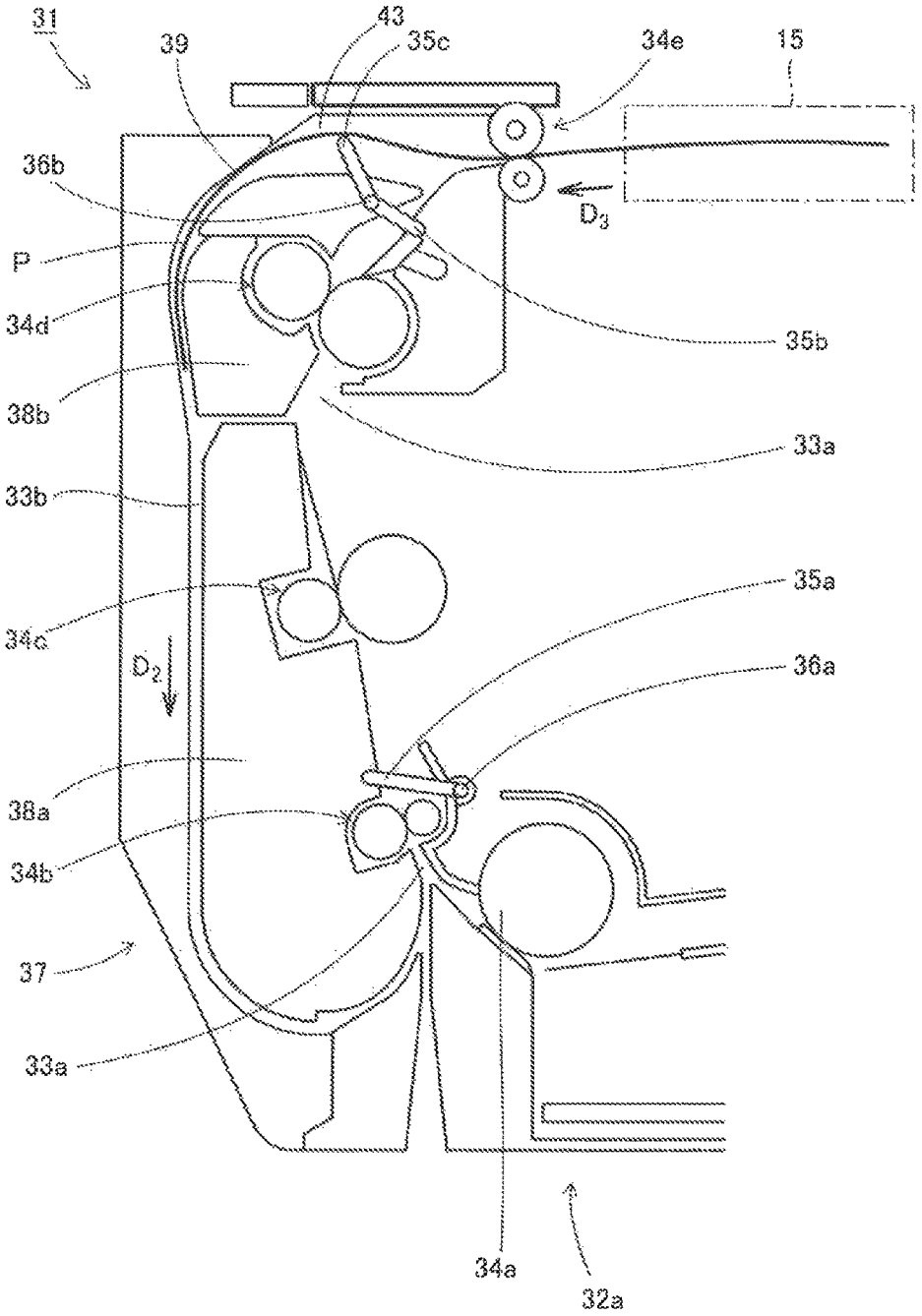
FIG. 7 depicts paper bent in a switchback mechanism.
Figure 8:
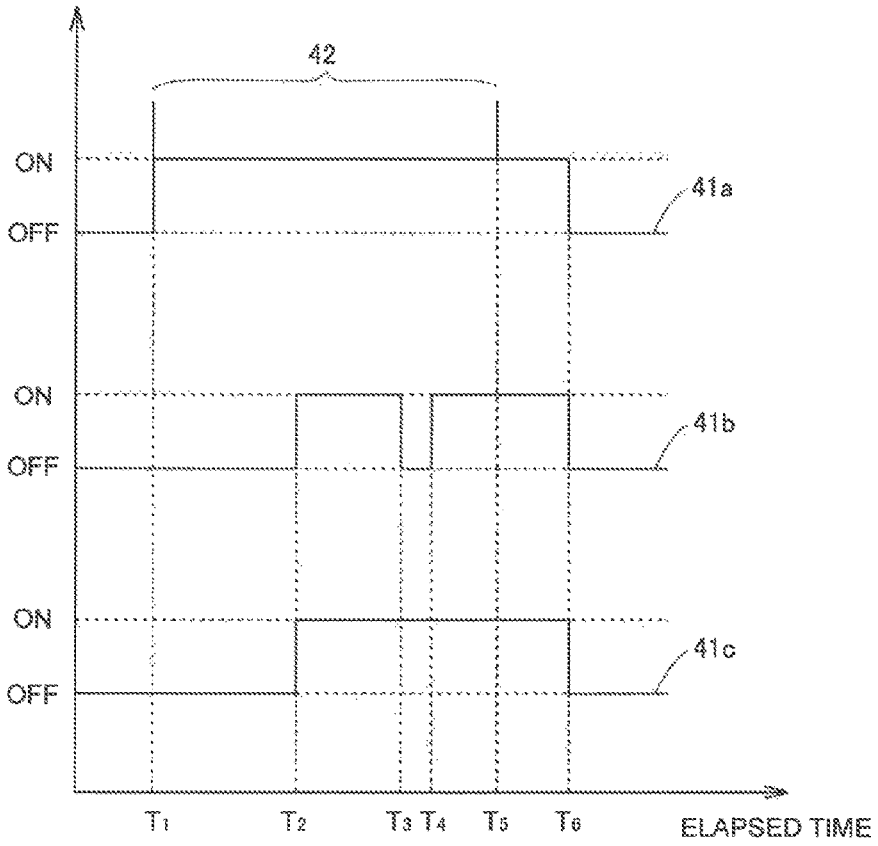
FIG. 8 is a graph showing the detection status of a two-sided sensor and the actuation status of the switchback mechanism.

More detailed description will be given below. FIG. 7 depicts paper P bent in the switchback mechanism 37. FIG. 7 corresponds to the drawings in FIGS. 3 to 5. FIG. 8 is a graph showing the detection status of the two-sided sensor 35*c* and the actuation status of the switchback mechanism 37. In FIG. 8, the vertical axis represents ON states or OFF states, while the horizontal axis represents elapsed time. In FIG. 8, a line 41*a* indicates an ON state or OFF state of the switchback mechanism 37, a line 41*b* indicates an ON state or OFF state of an actual two-sided sensor 35*c*, and a line 41*c* indicates an ON state or OFF state of a two-sided sensor 35*c* provided with a data ignorance period.

Referring to FIG. 8, the switchback mechanism 37 is assumed to be actuated at time T1. If the actuation determining section 26 determines that the switchback mechanism 37 has been actuated, the detection control section 27 controls the two-sided sensor 35*c* to perform detection except for a certain time period. In this description, the certain time period 42 ranges from time T1 to time T5. When the leading edge of the paper P reaches the position where the two-sided sensor 35*c* is provided, which is the second point, the two-sided sensor 35*c* changes from the OFF state to the ON state. This timing is represented by time T2.

In a case where the paper P is relatively thin, the paper P may sometimes bend in the area 43, so-called a play area, provided to the paper transport path 33*b* as shown in FIG. 7. The thinner the paper P is, the more apparently the paper bends. Paper P made of easy-to-bend materials and paper P with curl also tend to bend.

Such bent paper P cannot properly push the two-sided sensor 35*c* even through the paper P is conveyed in the paper transport path 33*b* with appropriate timing. This may sometimes cause the two-sided sensor 35*c* to change from the ON state to OFF state at time T3 as indicated by the line 41*b* even though the leading edge of the paper P has reached the position of the two-sided sensor 35*c* and has pushed it once into the ON state. The OFF state is changed to the ON state at time T4 while the paper P is being conveyed further in the paper transport path 33*b*. In short, the two-sided sensor 35*c* detects itself in the OFF state, or more specifically, detects that there is no paper P at the second point during a period from time T3 to time T4 even though the paper P is properly transported in the paper transport path 33*b*. Then, the two-sided sensor 35*c* detects itself in the ON state from time T4 to time T6, thereby detecting that the paper P is properly passing through the second point.

To prevent the two-sided sensor 35*c* from misconstruing the faulty detection as indicated by the line 41*b* as abnormal transportation of the paper P, the certain time period 42 is set as a data ignorance period. During the data ignorance period, even if the two-sided sensor 35*c* falls into the situation as shown FIG. 7, the two-sided sensor 35*c* maintains its detection status as shown by the line 41*c*, and therefore the possibility of mistakenly detecting abnormal transportation of the paper P will be reduced. In short, even if the situation as shown in FIG. 7 occurs at time T3, the two-sided sensor 35*c* does not regard a moment of its OFF state caused by the situation as a state in which the paper P has not reached yet. It should be noted that time T5 is when the answer to the question of S17 in FIG. 6 is YES.

The two-sided sensor 35*c* detects abnormal transportation of the paper P during the period from time T5 to time T6. Specifically, if the two-sided sensor 35*c* detects that it is in the OFF state after the certain time period 42 elapses and until time T6 at which the two-sided sensor 35*c* enters the OFF state, the two-sided sensor 35*c* resultantly detects abnormal transportation of the paper P.

On the other hand, the detection control section 27 controls the registration sensor 35*a* to constantly perform detection, and therefore the registration sensor 35*a* can properly detect abnormal transportation of the paper P. Since a data ignorance period is not set for the registration sensor 35*a* to detect abnormalities, the registration sensor 35*a* can detect abnormalities any time.

Thus, the multifunction peripheral 11 including the sheet feeding device 31 capable of properly transporting paper P can properly form images on the paper P.

Since the certain time period is set to be longer as the paper P becomes thinner, the data ignorance period can be calculated in accordance with the degree of how easy the paper P bends.

In this description, the first point is located before the position where the switchback mechanism 37 is provided on the paper transport path 33*a*, while the second point is located after the position where the switchback mechanism 37 is provided on the paper transport path 33*b*, and therefore abnormal transportation of paper P before and after the switchback mechanism 37 can be more properly detected.

In this description, the registration sensor 35*a* operates as a first paper pass detection unit. Specifically, the registration sensor 35*a* is a paper pass detection unit placed downstream from the paper feed cassette 32*a*, and there is no paper pass detection unit for detecting that paper P has passed through on the paper transport path 33*a* between the first point and paper feed cassette 32*a*. Constant detection by the registration sensor 35*a* can achieve reliable detection of abnormal transportation of paper P even if, for example, the paper P is torn or damaged while being transported from the paper feed cassette 32*a*, or the paper P being transported is different in size from the preset paper P.

In the above-described embodiment, the registration sensor 35*a* is referred to as a first paper pass detection unit; however, the present disclosure is not limited thereto, and the ejection sensor 35*b* can be referred to as a first paper pass detection unit. Alternatively, both of the sensors can be referred to as a first paper pass detection unit.

In the above-described embodiment, the certain time period starts at the time at which the actuation determining section 26 determines that the switchback mechanism 37 has been actuated; however, the present disclosure is not limited thereto, and, for example, the certain time period can be set to start after a predetermined time period has elapsed since the switchback mechanism 37 was actuated.

In the above-described embodiment, the length of the certain time period can be configured to correlate with the type of paper. In this case, the correlation between the length of the certain time period and the type of paper is obtained from experimental data or the like, and is stored in the hard disk 16 or other storage units. Paper can be transported more properly by using the correlation data.

Although the sheet feeding device according to the above-described embodiment is configured to include the switchback mechanism 37 as a transport processing mechanism that feeds paper backward, the present disclosure is not limited thereto, and any mechanism capable of performing some kinds of processing to transport paper may be used as a transport processing mechanism. For example, the transport processing mechanism to be adopted may invert paper P to transport it.

Although the sheet feeding device 31 according to the above-described embodiment is configured to be provided in the multifunction peripheral 11, the present disclosure is not limited thereto. Specifically, the sheet feeding device 31 according to the disclosure is a sheet feeding device for feeding paper, and can be configured to include: a paper transport path serving as a route through which paper is conveyed; a first paper pass detection unit detecting that the paper passes through a first point on the paper transport path; a second paper pass detection unit detecting that the paper passes through a second point, which is different from the first point, on the paper transport path; a transport processing mechanism performing predetermined transportation processing on the paper traveling on the paper transport path; an actuation determining section determining whether the transport processing mechanism has been actuated; and a detection control section controlling the first paper pass detection unit to constantly perform detection, and if the actuation determining section detects that the transport processing mechanism has been actuated, controlling the second paper pass detection unit to perform detection except for a certain time period.

It should be understood that the embodiment disclosed herein is illustrative and non-restrictive in every respect. The scope of the present disclosure is defined by the terms of the claims, rather than by the foregoing description, and is intended to include any modifications within the scope and meaning equivalent to the terms of the claims.

The sheet feeding device and image forming apparatus according to the present disclosure can be effectively used especially to meet a demand for the proper transportation of paper.

What is claimed is:

1. A sheet feeding device for feeding paper comprising:
a paper transport route through which paper is conveyed;
a first paper pass detection unit detecting that the paper passes through a first point on the paper transport route;
a second paper pass detection unit detecting that the paper passes through a second point, which is different from the first point, on the paper transport route;
a transport processing mechanism performing predetermined transportation processing on the paper traveling on the paper transport route;
an actuation determining section determining whether the transport processing mechanism has been actuated;
a hard disk storing data about types of paper and data about the thickness of the corresponding types of paper;
an acquiring section acquiring data about thickness associated with the type of the paper; and
a detection control section controlling the first paper pass detection unit to constantly perform detection, and if the actuation determining section detects that the transport processing mechanism has been actuated, controlling the second paper pass detection unit to perform detection except for a certain time period, wherein
the length of the certain time period correlates with the type of paper and
the certain time period is set to be longer as the paper is thinner.

2. The sheet feeding device according to claim 1, wherein
the certain time period starts at the time when the actuation determining section determines that the transport processing mechanism has been actuated.

3. The sheet feeding device according to claim 1, wherein
the transport processing mechanism includes a switchback mechanism that feeds the paper backward.

4. The sheet feeding device according to claim 3, wherein
at least one of the first paper pass detection unit and the second paper pass detection unit detects the state of the paper passing through by determining the position of its detecting member that tilts when the paper makes contact with the detecting member, and moves back to the original position when the paper breaks off contact with the detecting member.

5. The sheet feeding device according to claim 4, wherein
the first point is located before the position where the switchback mechanism is provided on the paper transport route, while the second point is located after the position where the switchback mechanism is provided on the paper transport route.

6. The sheet feeding device according to claim 3, further comprising
a paper feed cassette holding the paper, wherein
the paper transport route extends from the paper feed cassette, and
no paper pass detection unit for detecting that the paper passes through the unit is provided between the first point and the paper feed cassette on the paper transport route.

7. The sheet feeding device according to claim 6, wherein
the first point is located before the position where the switchback mechanism is provided on the paper transport route, while the second point is located after the position where the switchback mechanism is provided on the paper transport.

8. The sheet feeding device according to claim 3, wherein
the first point is located before the position where the switchback mechanism is provided on the paper transport route, while the second point is located after the position where the switchback mechanism is provided on the paper transport.

9. The sheet feeding device according to claim 1, wherein
at least one of the first paper pass detection unit and the second paper pass detection unit detects the state of the paper passing through by determining the position of its detecting member that tilts when the paper makes contact with the detecting member, and moves back to the original position when the paper breaks off contact with the detecting member.

10. The sheet feeding device according to claim 9, further comprising
a paper feed cassette holding the paper, wherein
the paper transport route extends from the paper feed cassette, and
no paper pass detection unit for detecting that the paper passes through the unit is provided between the first point and the paper feed cassette on the paper transport route.

11. The sheet feeding device according to claim 1, further comprising
a paper feed cassette holding the paper, wherein
the paper transport route extends from the paper feed cassette, and
no paper pass detection unit for detecting that the paper passes through the unit is provided between the first point and the paper feed cassette on the paper transport route.

* * * * *